US006402646B1

(12) United States Patent
Wolf

(10) Patent No.: US 6,402,646 B1
(45) Date of Patent: Jun. 11, 2002

(54) SPORTS AND GAME RACKET UTILIZING A PREASSEMBLED WOVEN STRINGING SURFACE

(76) Inventor: Peter A. Wolf, 352 Little Quarry Rd., Gaithersburg, MD (US) 20878

( * ) Notice: Subject to any disclaimer, the term of this patent is extended or adjusted under 35 U.S.C. 154(b) by 0 days.

(21) Appl. No.: 09/571,156

(22) Filed: May 16, 2000

Related U.S. Application Data

(60) Provisional application No. 60/141,064, filed on Jun. 25, 1999.

(51) Int. Cl.[7] ..... A63B 49/02; A63B 51/04

(52) U.S. Cl. ..... 473/543; 473/528; 473/532

(58) Field of Search ..... 473/532, 534, 473/564, 5, 6, 543, 528, 541

(56) References Cited

U.S. PATENT DOCUMENTS 3,734,499 A * 5/1973 Goldstein ..... 473/528
4,238,262 A * 12/1980 Fishel ..... 473/543 X
4,913,430 A * 4/1990 Lichtenstein ..... 473/543
5,131,653 A * 7/1992 Yu ..... 473/541
5,188,359 A * 2/1993 Wu ..... 473/528
5,294,114 A * 3/1994 Stillinger ..... 473/528
5,324,029 A * 6/1994 Kim ..... 473/573 X
5,326,097 A * 7/1994 Yu ..... 473/528
5,735,759 A * 4/1998 Lin et al. ..... 473/543 X

FOREIGN PATENT DOCUMENTS

FR 2581317 * 11/1986 ..... 473/FOR 185

* cited by examiner

*Primary Examiner*—Raleigh W. Chiu

(57) ABSTRACT

The present invention relates to the design and manufacture of sport rackets, and in particular to those of tennis rackets. The improvements herein also apply to rackets used as toys and for games. Particular focus is on the design of the string surface of the racket utilizing pre-woven strings, which necessitates a radical redesign of the racket assembly and the manufacturing process. The redesign also implies a change in the marketing of the racket and the strings.

2 Claims, 7 Drawing Sheets

SPORTS AND GAME RACKET UTILIZING A PREASSEMBLED WOVEN STRINGING SURFACE

Applicant desires priority under 35 U.S.C. 119(e) based on the Provisional Application No. 60/141,064 filed Jun. 25, 1999 on behalf of the applicant by Leopold Presser of Scully Scott Murphy & Presser at 400 Garden City Plaza, Garden City N.Y. 11530.

BACKGROUND OF THE INVENTION

The late 1960's witnessed a gradual change from conventional wood rackets to metal and plastic ones. These changes produced new challenges to the stringing of the rackets because the new materials produced new stresses on the string materials as well as on the rackets themselves. For example, the Wilson T2000 racket supported the strings from metal wire wound around the metal frame. Other designs utilized plastic grommets around the strings, at the contact points with the frame, to reduce the stress on the strings thereby reducing the probability of string failure.

In the 1970's and 1980's virtually all tennis rackets were made of plastic composites, utilizing the special properties, relating to strength and weight, of these high-tech materials. These new designs made possible the return to the more conventional stringing design and process, where the strings were woven through holes at the periphery of the racket head, as in the original wood rackets. This period also saw the emergence of numerous racket sizes, e.g. the mid and oversize rackets, tailored to the specific needs and capabilities of the players.

During especially the 1990's special attention was placed not only the strength and weight of the rackets, but to their specific vibrational and torsional properties.

These vibrational and torsional properties have a considerable affect on the response of the racket at the moment of impact with the ball, which in turn improve the reliability of the bounce and lower the stress on the player's arm and wrist.

Along the way improvements were also made to the strings and to string pattern design. New synthetic and composite fibers were made to increase their performance and to withstand the higher tensions utilized especially by the more skilled players. The string pattern was also redesigned in most instances, whereby there was a denser spacing of the strings near the center of the racket head, increasing the "sweet spot" of the strike area.

The combined result of all these changes on the game of tennis has been nothing short of revolutionary. The pace of the game increased dramatically, and gave the professionals considerably more control over the flight of the ball. The impact on the non-professional varied according to their level of expertise.

Despite the improvements mentioned above, the overall stringing design has not changed dramatically from the days of the wooden rackets (except for the slight variations in string spacing). A modern string pattern still consists of string spaced roughly ⅜ in. To ⅝ in. apart. This often leads to significant movement of the strings, in the plane of the racket head, due to the high spin introduced to the ball at the moment of impact, and causes an uneven and irregular spacing of the strings. This in turn makes subsequent bounces less reliable, and often results in string failure. A common sight at professional matches is the readjustment of the strings by the players between points; in fact, tools have been designed and patented specifically for this string adjustment. Also, despite the dramatic improvement in materials, the breakage of string is a common occurrence due to the enormous stresses experienced by these modern rackets and strings.

It is also significant that the stringing of the racket is done by hand, by individually weaving the string through the holes in the racket head and between the other strings. It requires considerable skill and expertise to achieve the level of consistency and reproducibility required by the top players.

SUMMARY OF THE INVENTION

It is the purpose of this invention to redesign sports rackets, and in particular tennis rackets, so that they utilize pre-woven fabric as the string surface. I order to accomplish this, the racket frame is redesigned as well in order to accept and hold the pre-woven and pre-stretched fabric in place under tension.

The benefits of this racket design are:

more consistent string surface larger "sweet spot" for a more consistent ball bounce a string surface less prone to string failure higher flexibility in material choices to achieve a variety of string properties easily manufacturable string surface highly reproducible string tensions just to name a few.

Woven Strings

The weaving of fibers by the textile industry has been automated to a very high degree, and an essentially limitless variety of fibers can be woven into intricate patterns with high reproducibility. It is a relatively easy task to weave a length of fabric where a number of variables, including the fibre materials, fibre diameter, pattern design, fibre spacing etc., are varied. In particular, it is possible to reduce the spacing between the strings, which in turn permits the use of finer fibers. Finer and more numerous fibers reduce the tension on an individual string and makes the netting more reliable. It is possible to achieve very high strength fabrics (witness those used in sailing, parachutes, ropes etc.) even with the use of finer fibers. Careful attention must be paid to the spacing of the weave so that the racket head doesn't produce noticeable air resistance to the swing of the racket, It is quite easy, for example, to reduce the spacing of the strings to around 1 mm without encountering air resistance. The thickness of the individual fibers is reduced simultaneously as the spacing of the fibers is reduced, while keeping the overall strength of the fabric constant. The spacing of the fibers could be in the range ⅜ in. To 1/32 in. or even less, and the fibre diameter could be significantly less than currently in practice, depending on the mechanical properties of the fibre.

The string design flexibility is dramatically increased when one considers the use of machine woven fabrics for the tennis string surface. For example, special high strength, oriented fibers can be used. Fibers with special surface textures can be used to impart spin, for example fibers similar to those used in hook-and-loop (Velcro) closures (See U.S. Pat. No. 5,324,029). Even metal wires, alone or in conjunction with other materials, can be used. Fibers can be mixed to match the needs of individual players.

One of the most important benefit of this design is the uniformity achieved by the fact that the string units are made with machines that can reproduce the same tension every time. The weaving is also done with machines according to tight specifications already developed in the weaving industry.

Racket Design

The use of pre woven fabric requires the complete redesign of the racket frame.

The fabric has to be pre-stretched, and then placed, under tension, into the frame.

Numerous design possibilities are possible.

Conceptually the easiest is to consider a two-part frame where the fabric is squeezed between two dissimilar halves. Each half can be visualized as if a conventional racket was split in half, in the plane of the racket, with a groove in one and a corresponding ridge in the other along the perimeter of the racket face (see FIG. 1). The fabric is held between the frame loops quite securely because the tension forces (even at the moment of impact with the ball) are perpendicular to the forces of friction holding the fabric between the two halves of the racket. This design can be easily modified to contain several ridges and grooves in order to hold the woven strings more securely.

An alternate design would utilize two identical frame halves, with a groove in each one. The fabric would be wedged in between the two halves with a ring (see. FIG. 2). One or two layers of woven fabric could be used (two layers are shown in FIG. 2). The frame could be made of the same high-tech materials as present ones, and the ring could be of metal, for example. The choice of racket materials are high, and can be adjusted to achieve particular strength, weight, and vibrational properties as in presently used rackets. Manufacturing may also be simplified. For example, the two identical frame halves could be injection molded over an oriented, high strength fiber mesh.

In both of the above designs the woven fabric is placed, under tension, between the frame halves. Thus the (re) stringing would require an apparatus that would stretch the fabric, and a press to force the racket frame halves together. Such fabric stretching devices and presses (e.g. a simple screw or hydraulic press) are already in existence in other technologies and markets, and are easily adapted for this application by those experienced in current technologies. The two halves of the racket would be held together securely by metal or plastic spring clips, or by screws or wire loops, etc. This is easily accomplished by those familiar with current technologies.

Other designs are possible whereby the woven strings are pre-assembled, under tension, at a manufacturing site, and are simply placed into the racket at the time of (re)stringing.

According to this concept the stretched fabric is placed between two identical flat metal (or plastic) rings. The metal/woven net/metal sandwich layers are pressed together, whereby a corrugated pattern is imparted by the press, and the fabric, under tension, is held firmly in place. The outside edge of the resulting string surface can be rolled around the perimeter, much like the top of a metal can (eg. a soft drink or food can) is rolled around the edge formed by the top and its side (see FIG. 3). Alternatively, the crimped metal/woven string/metal sandwich could be folded in a "Z"-fold manner around the edge (see FIG. 4). The resulting, stand alone, string surface is then held together by the two equal halves of the tennis racket, as in example 2 above.

Another design would involve the preparation of a woven string unit by pressing the taught fabric between two or more concentric metal or plastic rings (see FIG. 5). The fabric remains taught by virtue of the fact that the tension forces in the plane of the racket face are perpendicular to the frictional forces holding them between the concentric rings.

This stand alone string unit concept (e.g. Examples 3 and 5) is also adaptable to a single frame design. Here the racket is made of a single piece of bent frame (metal, plastic or composite) with a groove in the center to accept the string unit. The frame is flexed slightly apart to accept the woven string unit. After the string unit is inserted, the throat and handle part of the racket frame is squeezed together and secured at the throat and handle with screws or clips (see FIG. 6).

The shape and size of the frame could be easily varied, as they are done presently. In the above designs, where two parts of the frame are indicated, the two racket frame halves could be held together by several screws placed around the racket head periphery or by spring clips. Here too, the choice of materials could be used to achieve specific strength and weight balances.

The designs utilizing separate pre-stretched, woven string units are especially suited to interesting marketing alternatives. The frame halves and the string surfaces, pre-stretched and packaged, could be sold separately and assembled at the point of purchase or at the restringing site (e.g. at a tennis match). Restringing would be reduced to separating the two racket frame halves and inserting a new pre-stretched woven string surface. The woven string units could be packaged at preselected tensions, with variations in types of string, or any other attribute that is designed into the weave. The consumer can choose whatever tension, and other attribute may suit his or her game and style.

Figure 1:
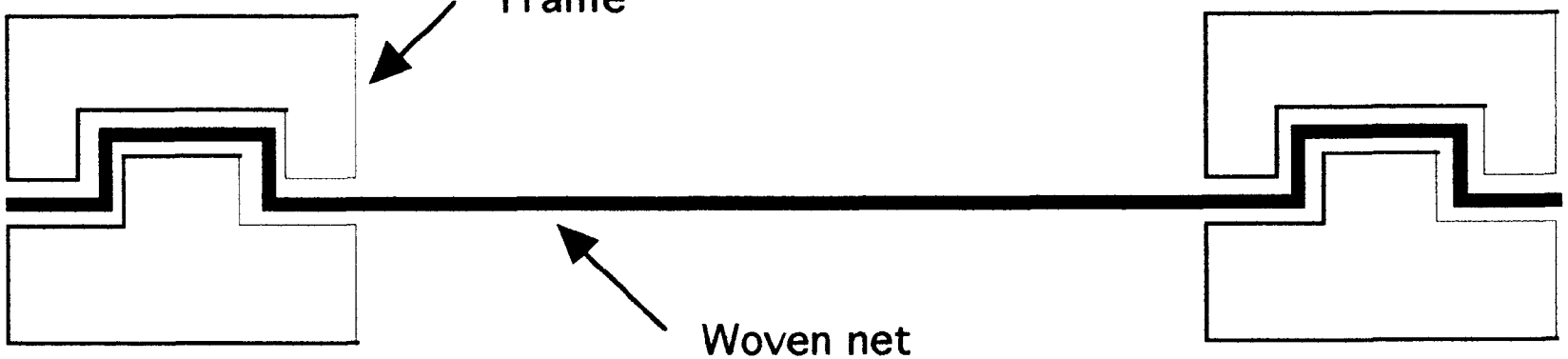
FIG. 1. A sectional view (not to scale) of a two part racket holding a woven net under tension.
Figure 2:
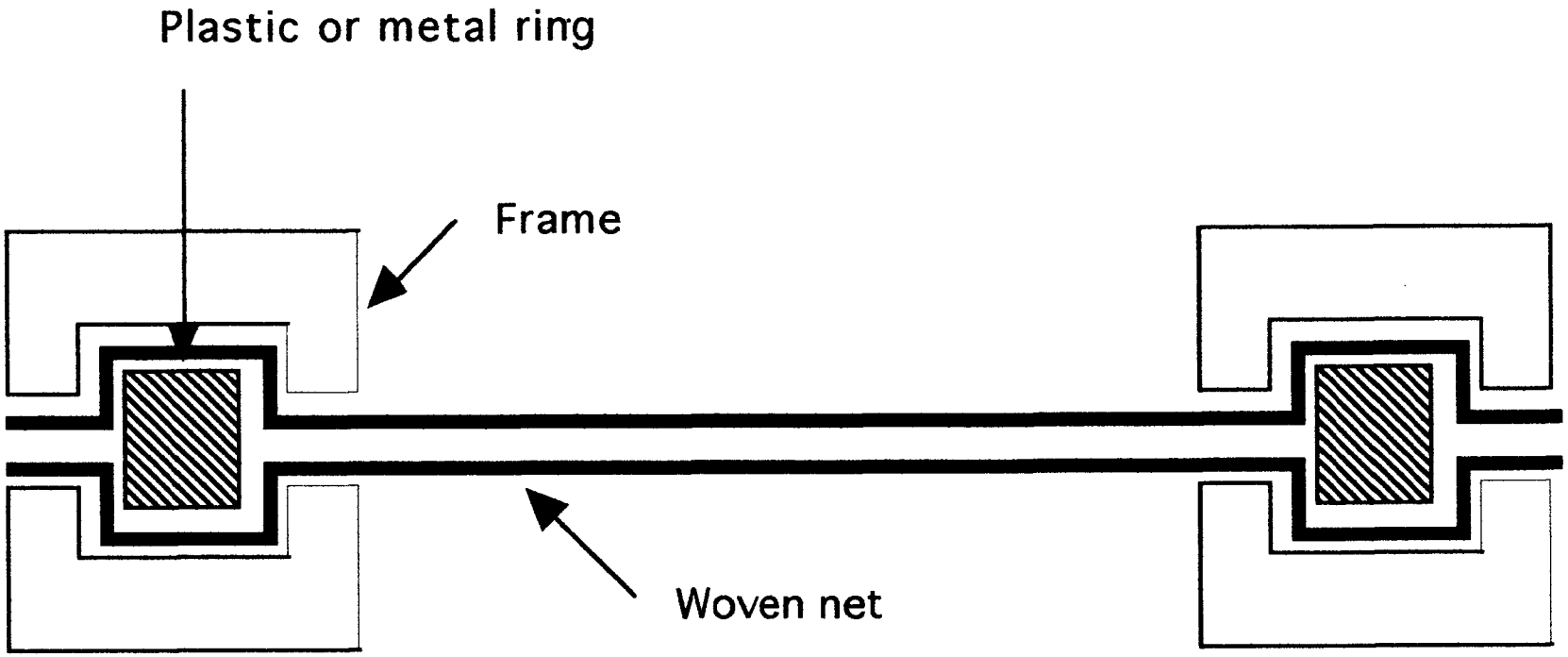
FIG. 2. A sectional view (not to scale) of a two part racket holding a woven net under tension by means of a ring wedged between the frame parts.
Figure 3:
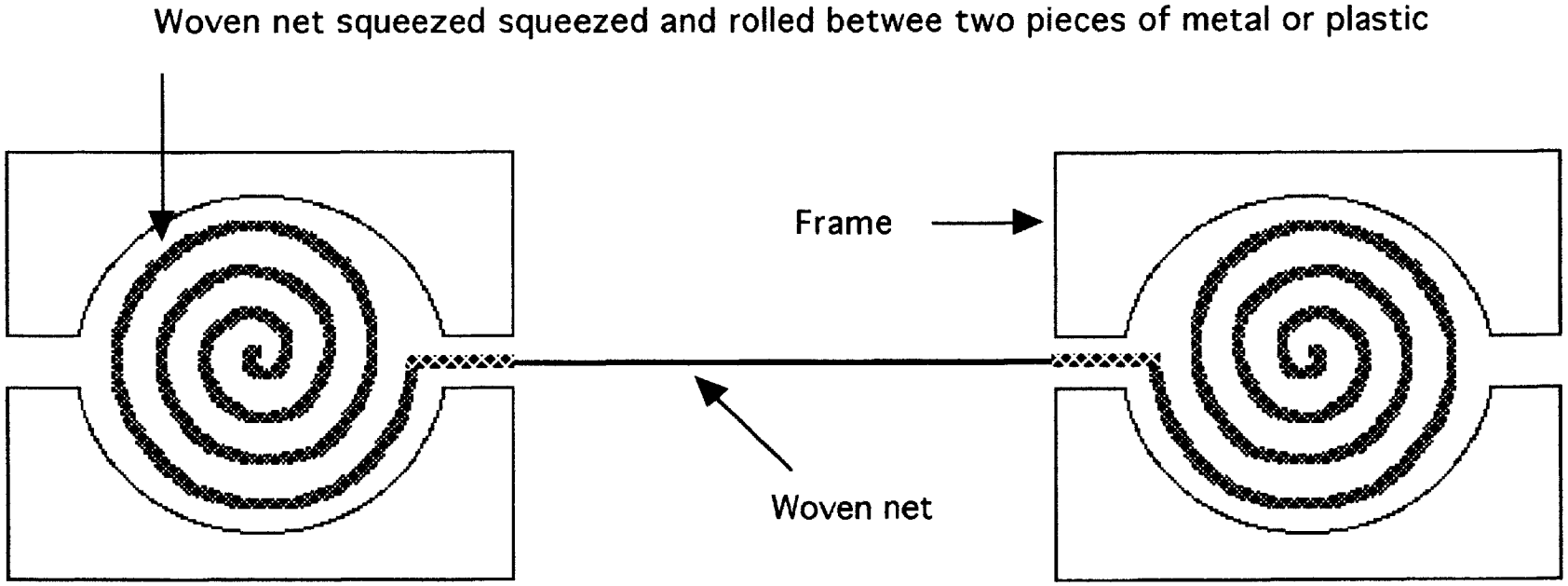
FIG. 3. A sectional view (not to scale) of a two part racket holding a stand-alone string unit which is prepared by crimping and rolling the edges of the string unit into a spiral.
Figure 4:
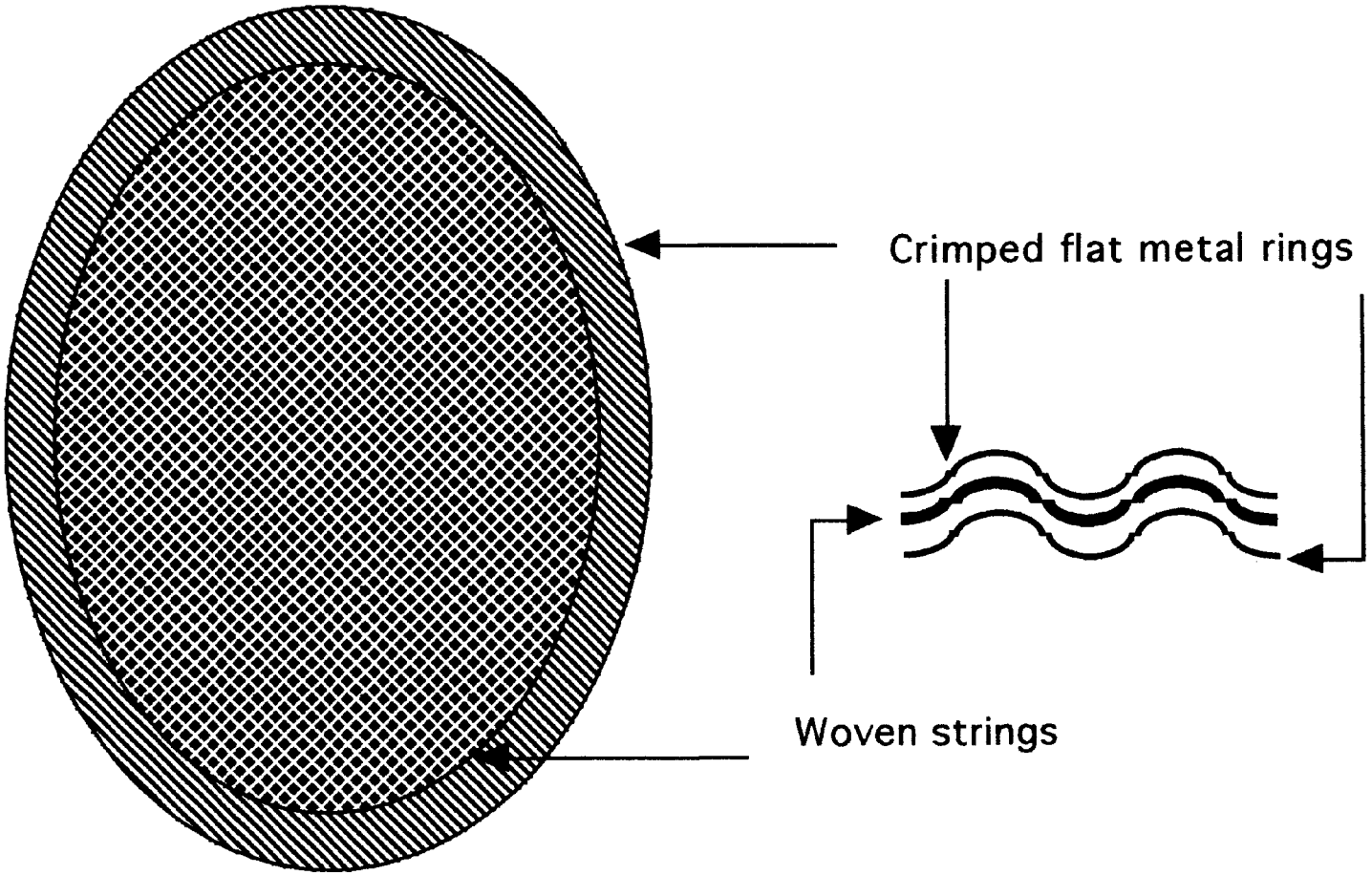
FIG. 4. A view of the stand-alone string unit (shown in FIG. 3.).
Figure 5A:
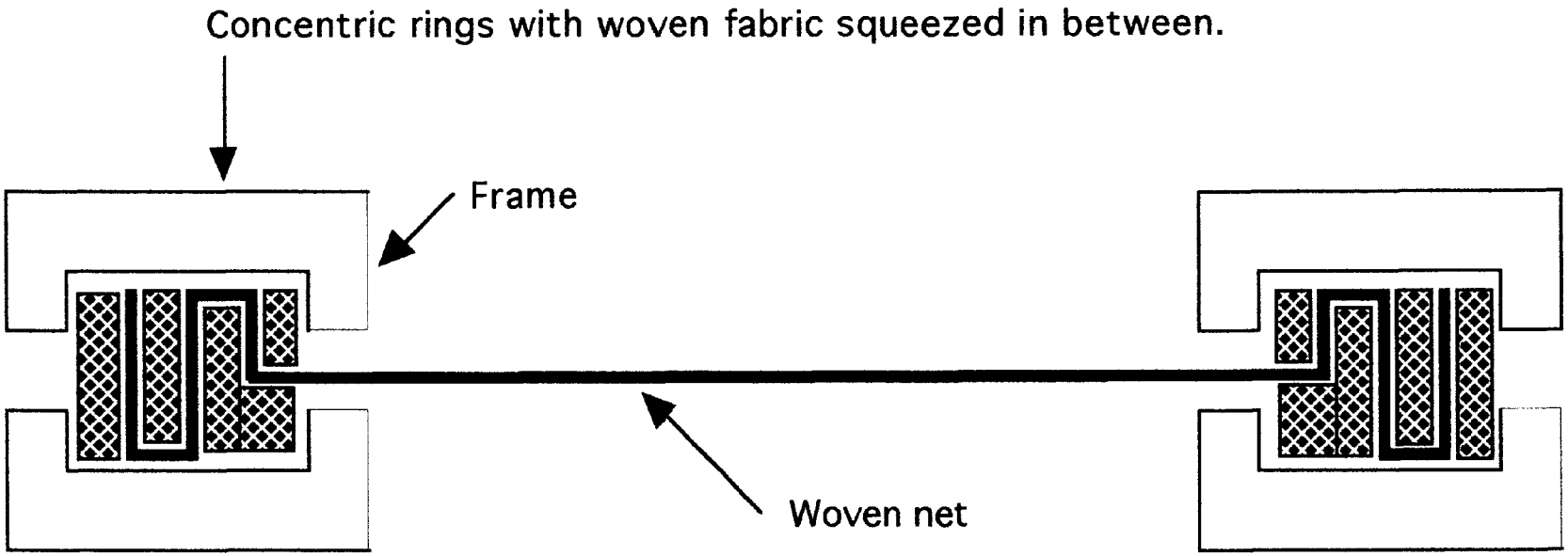
FIG. 5*a*. A sectional view (not to scale) of a two part racket holding a stand-alone string unit made with concentric rings.
Figure 5B:
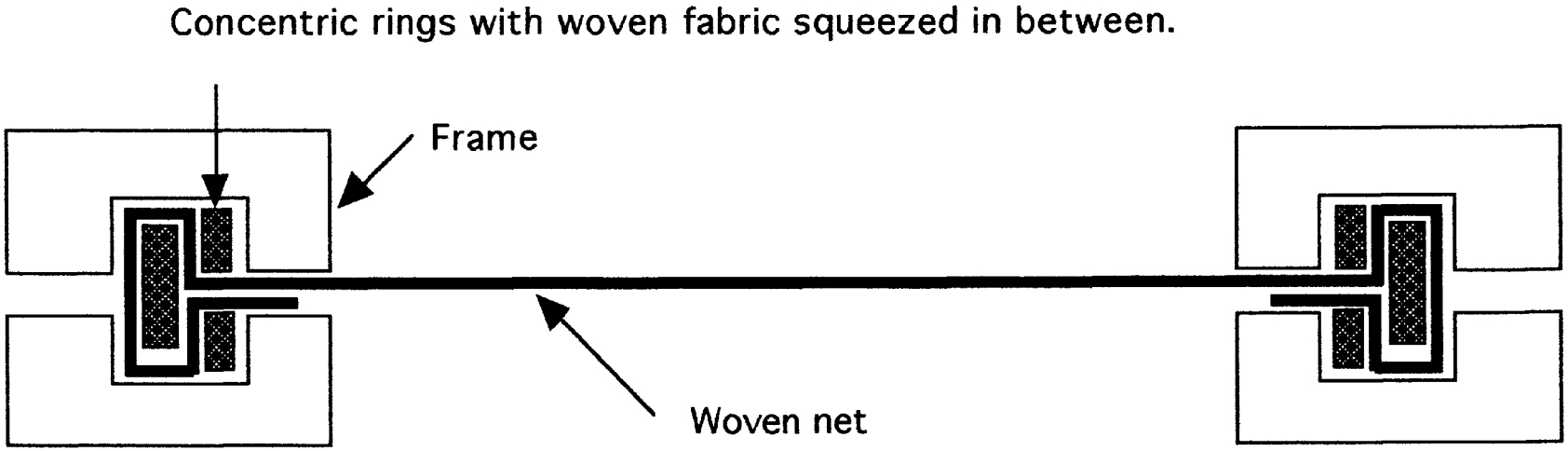
FIG. 5*b*. An alternative design of FIG. 5*a*.
Figure 6:
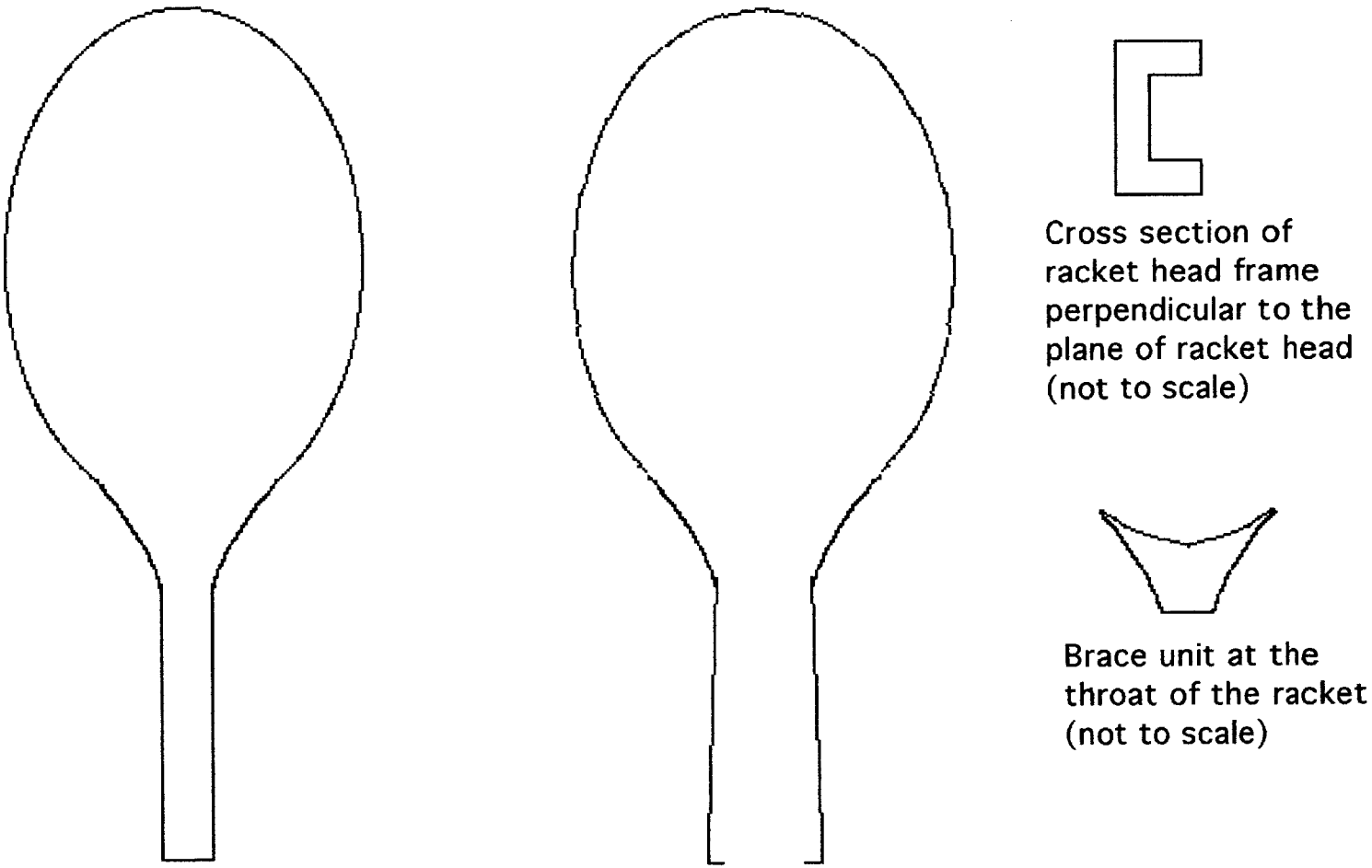
FIG. 6. A schematic view of a one piece racket frame designed to accept a stand-alone string unit.

What is claimed is:

1. A stand alone pre-woven string surface unit intended for a sports racket, under tension, and held firm by a metal or synthetic composite ring structure, said stand alone string surface unit consists of pre-woven strings, under preselected tension, between two annular sheets of metal or composite (anticipating the size and shape of a conventional tennis or sports racket frame), forming a layered, and optionally a crimped or corrugated structure around the perimeter and in the plane of the string surface, said pre-woven string surface, with a string spacing of at least twice the thickness of the strings, selected from the group consisting of gut, synthetic plastic yarn, metal or a suitable combination of them, said layered structure with a spiral cross section, perpendicular to the plane of the string surface, and concentric with the string surface, running continuously along its perimeter, alternatively, said layered structure with a zig-zag ("Z"-fold) cross section, perpendicular to the plane of the string surface, and concentric with the string surface, running continuously along its perimeter, alternatively, said stand-alone string surface unit consists of the woven strings, under preselected tension, between two or more concentric rings, such that in a plane perpendicular to the string surface, the strings are in an "S"-like configuration between the concentric rings, said rings selected from the group consisting of metal, plastic, synthetic carbon fibre or a suitable combination of them.

2. A stand alone pre-woven string surface intended for a tennis racket, under tension, and held firm by a metal ring structure according to claim 1.

* * * * *